United States Patent [19]

Martin

[11] 4,098,386

[45] Jul. 4, 1978

[54] ADJUSTABLE OVERSIZE COIN DETECTOR ASSEMBLY

[75] Inventor: Bart G. Martin, St. Louis, Mo.

[73] Assignee: Coin Acceptors, Inc., St. Louis, Mo.

[21] Appl. No.: 734,604

[22] Filed: Oct. 21, 1976

Related U.S. Application Data

[63] Continuation-in-part of Ser. No. 586,998, Jun. 13, 1975, Pat. No. 3,991,867.

[51] Int. Cl.[2] ..... G07F 3/02

[52] U.S. Cl. ..... 194/102

[58] Field of Search ..... 194/102, 99, 103

[56] References Cited

U.S. PATENT DOCUMENTS 3,625,329 12/1971 Stewart ..... 194/102

*Primary Examiner*—Stanley H. Tollberg

*Attorney, Agent, or Firm*—Cohn, Powell & Hind

[57] ABSTRACT

An adjustable oversize coin detector assembly having a coin cradle and a lever pivotally mounted on a frame, the lever having a shoulder disposed for contact with the edge of a coin carried in the cradle arms for pivoting the lever and increasing the distance between the lever shoulder and one cradle arm. A stop engages the lever to limit pivotal movement of the lever and determine the maximum distance between the lever shoulder and the said one cradle arm for allowing a coin of acceptable size to pass between the lever shoulder and said one cradle arm to the passageway, and for precluding passage of an oversize coin between the lever shoulder and the said one cradle arm. The stop is adjustably mounted for selectively varying the predetermined distance between the lever shoulder and said one cradle arm, and thereby selectively determining the size of the coin that will pass between the lever shoulder and the said one cradle arm to the passageway.

1 Claim, 8 Drawing Figures

ADJUSTABLE OVERSIZE COIN DETECTOR ASSEMBLY

CROSS REFERENCE TO RELATED APPLICATION

This application is a continuation-in-part of co-pending application Ser. No. 586,998, filed June 13, 1975 and entitled "Coin Testing and Separating Apparatus", and issued Nov. 16, 1976 as U.S. Pat. No. 3,991,867.

BACKGROUND OF THE INVENTION

The present invention relates generally to a coin testing and separating apparatus of the kind commonly employed in modern vending machines. More particularly, the invention pertains to an improved detector mechanism for testing and separating coins on the basis of size.

The improved cradle mechanism discriminates coins which are essentially alike in size. This function of the cradle is accomplished before passing the coins to the acceptance passageway of the device.

There are some coins that have approximately the same diameter but have greatly different valuations. One of the difficult problems is to test these coins and permit only the coin of the true valuation to pass to the acceptance passageway. It has not been heretofore possible to provide a mechanism that would cooperate effectively with the cradle assembly to sense very small differences in coin diameters so that the spurious coin having only a very small difference in diameter size from the coin of true valuation, would be precluded from passing to the acceptance passageway.

SUMMARY OF THE INVENTION

The present coin detector assembly cooperates with the cradle mechanism to sense very small differences in coin size, and is capable of allowing the coin of true valuation to pass to the acceptance passageway and yet preclude the passage of a spurious coin of only slightly different size from entering the acceptance passageway. The mechanism can be finely adjusted both in the factory, and in the field during usage in the vending machine, to detect coins having diameter differences of say only 0.001–0.002 inches.

The oversize coin detector assembly has a coin cradle and a cooperating lever pivotally mounted on a frame, the cradle including a pair of cradle arms for conveying a coin to a passageway, and the lever having a shoulder disposed for contacting the edge of a coin carried in the cradle arms. The lever shoulder makes contact with the coin edge to pivot the lever and increase the difference between the lever shoulder and one cradle arm. A stop means is provided to engage the lever and limit pivotal movement of the lever to determine the maximum distance between the lever shoulder and the said one cradle arm, whereby a coin of acceptable size will pass between the lever shoulder and the said one cradle arm to the passageway, and an oversize coin will be precluded from passing between the lever shoulder and the said one cradle arm.

The oversize coin detector assembly can be finely adjusted to sense very small differences in coin diameters because the stop means is adjustably mounted to engage and limit movement of the lever at selective rotated positions of the lever for selectively varying the predetermined distance between the lever shoulder and the said one cradle arm.

More particularly, to provide this adjustable feature with its attendant advantages, the stop means includes a fastener that mounts a stop member on the frame, the fastener allowing the stop member selectively to be moved toward and away from the lever and then to be fixed for engaging and limiting movement of the lever at a selective rotated position of the lever.

In the present cradle assembly, the lever has a first shoulder that is latchingly engageable with the cradle to limit cradle movement and prevent the cradle from conveying coins to the acceptance passageway, and a second shoulder disposed for contact with the edge of the coin carried in the cradle arms. The second lever shoulder makes slidable contact with the coin edge to pivot the latch lever, and thereby displace the first lever shoulder to a non-latching position relative to the cradle, and increase the distance between the second lever shoulder and the one cradle arm.

DESCRIPTION OF THE PREFERRED EMBODIMENT

Figure 1:
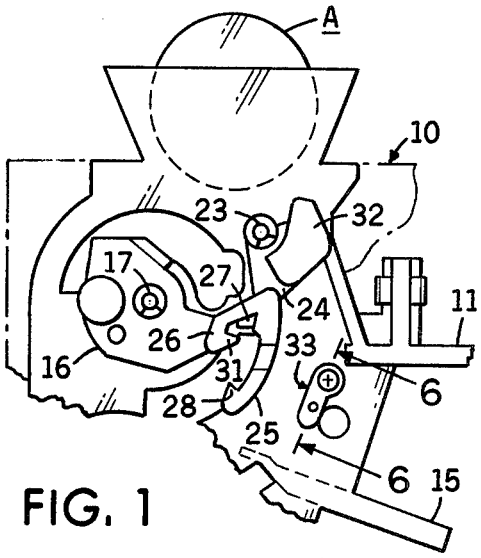
FIG. 1 is a fragmentary, elevational view of the outer side of a frame part, with cradle and latch lever in their normal positions for receiving a coin.
Figure 7:
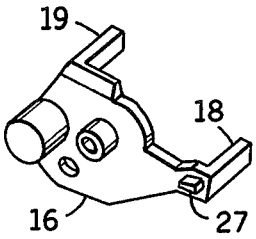
Figure 8:
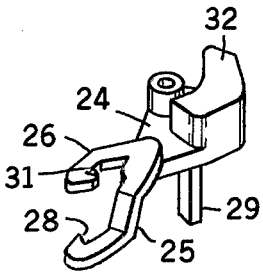
Figure 6:
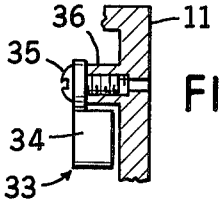
FIG. 6 is an enlarged fragmentary, cross-sectional view of the stop means as taken on line 6—6 of FIG. 1, and FIGS. 7 and 8 are perspective views of the cradle and latch lever respectively.

Referring now by characters of reference to the drawing, a fragmentary part of a base plate for a coin acceptor is indicated generally by 10. Mounted on the base plate 10 by hinge means (not shown) is a frame member or gate, a portion of which is indicated at 11. The base plate 10 and gate 11, together with spaced-apart embossments 12 and 13 on the inner side of the gate 11 define a coin entrance passage 14. Also formed on the inner side of gate 11 and spaced below the entrance passage 14, is an inclined rail 15 which in part, defines an acceptance passageway.

A cradle 16, on the outer side of the gate 11 at a level below the entrance passage 14 and above rail 15, serves to test coins for size and weight. If a coin is found to be acceptable in these respects, the cradle 16 will tilt incident to transferring the coin to the rail 15 for further progress through the apparatus. If the tested coin is oversize or underweight, it will be retained in the cradle 16 until released by scavenging means, not shown, as is well known in the art.

The cradle 16 is pivotally mounted on a pin 17 adjacent to the outer side of gate 11. The cradle 16 is provided with spaced-apart arms 18 and 19 that project inwardly through openings 20 and 21 respectively in the gate 11 to the opposite or inner side of the gate, in position to intercept normal or undersize or oversize coins descending from the entrance passage 14. Coins which are of insufficient size as to be caught by the cradle arms 18 and 19 will pass through the space therebetween, and thence through a gap 22 in the rail 15 for passage either to subsequent testing means or to a coin return chute, not shown.

The term "undersized" indicates a slightly less diameter than the diameter of the true value coin, while the term "oversized" designates a slightly greater diameter.

As will be understood, a coin of adequate size and weight which is caught by the cradle arms 18–19, will overbalance and tilt the cradle 16 in the general direction of rail 15. Unless the cradle movement is restrained by means subsequently described, the cradle 16 will tilt sufficiently to spill the coin onto the rail 15, whereupon the coin will progress toward an acceptance chute for actuating a vend switch or other means.

Pivotally mounted by pin 23 to the gate 11, is a cradle latch lever 24. The lower end portion of lever 24 is bifurcated to provide spaced leg portions 25 and 26 of unequal length. These leg portions 25–26 are arranged so as to flank opposite sides of the path of movement of a stud 27 that projects from the outer face of the cradle 16 in substantial alignment with the lower inwardly projecting cradle arm 18. The longer leg 25 of lever 24 is provided with a catch shoulder 28 which normally extends into the path of movement of the cradle leg 18 to limit cradle rotation and prevent the release of a coin carried thereby unless the latch lever 24 is moved to a "cradle-free" position.

The latch lever 24 is provided with an actuating shoulder 29 that projects through an opening 30 in the gate 11. The shoulder 29 is located on lever 23, in relation to the cradle arms 18–19 and to the catch shoulder 28, such that a coin being carried by the cradle 16 will make edge surface contact with the shoulder 29.

If the lever shoulder 29 is of a type and is disposed to make a friction engagement with a milled edge of a coin as is disclosed in co-pending U.S. Pat. No. 3,991,867 the cradle 16 and the latch lever 24 will cooperate to prevent movement of the coin and cradle 16 so that the milled coin will be retained on the cradle 16 until released by suitable scavenging means. A smooth edged coin of proper diameter will slide on such a lever shoulder 29 and will swing the lever 24 and catch shoulder 28 to a point clear of the cradle arm 18, thereby allowing the cradle 16 to rotate under the weight of the coin sufficiently to spill the coin therefrom and on to the rail 15. However, the present oversize coin detector assembly will operate whether or not the lever shoulder 29 makes such a friction contact with a milled edge coin.

Also, as disclosed in co-pending application Ser. No. 586,998, the second shorter leg 26 of the latch lever 23 serves to prevent the latch lever 24 from being actuated to a cradle-release position by abnormal movement of an undersized coin in the entrance passage 14, such as heretofore has been known to occur when a small coin has been dropped or impelled in the coin-receiving slot in a way to cause it to strike the cradle arm 18 and the shoulder 29 of the latch lever 24 at about the same instant. With the latch lever 24, the impact of such an errant small coin against the shoulder 29 will move the lever 24 in a direction to bring a catch shoulder 21 on lever leg 26 into the path of the cradle stud 27. The cradle 16 will thereby be momentarily prevented from rocking sufficiently to allow such a small coin to pass over the cradle arm 18 and onto the rail 15. In such cases, the coin can now be caught as a normal undersize coin as previously mentioned, and can be released by operation of suitable scavenging means, or the small coin, in some instances, will pass between the cradle arms 18–19 and drop through the gap 22 in rail 15 to a reject chute. Also, if an undersized coin only hits cradle arm 18, its downward motion could possibly move arm 18 downwardly to a position where the distance between arm 18 and lever shoulder 29 is greater than the diameter of the undersized coin, and the undersized coin will then pass between cradle arm 18 and lever shoulder 29 and will be deposited on rail 15. To prevent this from happening, the lever 24 is counterbalanced by weight 32. The lever 24 is only prevented from moving under the loading of weight 32 by engagement of cradle stud 27 with an adjacent lever surface. As the small coin strikes cradle arm 18, the arm 18 moves downwardly and causes sharp disengagement of stud 27 and adjacent lever surface. However, stud 27 strikes catch shoulder 31 to stop further rotation of the cradle 16 and the lever 24, and the coin is then passed through the gap 22 to a reject chute. This structure and the operation is fully disclosed in co-pending application Ser. No. 586,998. The counterweight 32 on the latch lever 74 also provides sufficient contact pressure by the lever shoulder 29 against the edge surface of a coin on the cradle 16.

A stop means referred to by 33 is mounted on the gate 11 to engage the latch lever 24 to limit pivotal movement of the lever 24 and determine the maximum distance between the lever shoulder 29 and the cradle arm 18 for allowing a coin of acceptable size to pass between the lever shoulder 29 and the cradle arm 18 to the acceptance passageway, and for precluding passage of an oversize coin between the lever shoulder 29 and the cradle arm 18.

Particularly, the stop means 33 includes a stop arm 34 pivotally mounted by a screw fastener 35 to a stem 36 integrally formed on the gate 11. The screw 35 allows the stop arm 34 to be pivotally moved selectively toward and away from the latch lever 24, and then to be selectively fixed to engage and limit movement of the latch lever 24 at a selective rotated position of the lever 24. As will be understood, limiting the rotated movement of the latch lever 24 at different positions, allows for the predetermined distance between the lever shoulder 29 and the cradle arm 18 to be selectively varied, and thereby finely adjust the assembly in determining the size of the coin within extremely small tolerance that will pass therebetween to the acceptance passageway.

It is thought that the function of the cradle 16, latch lever 24 and the cooperating stop means 33 has become fully apparent from the foregoing detailed description of parts, but for completeness of disclosure, the operation will be briefly described. It will be assumed that initially the stop means has been adjusted and fixed in the position illustrated in FIGS. 1–3.

Figure 2:
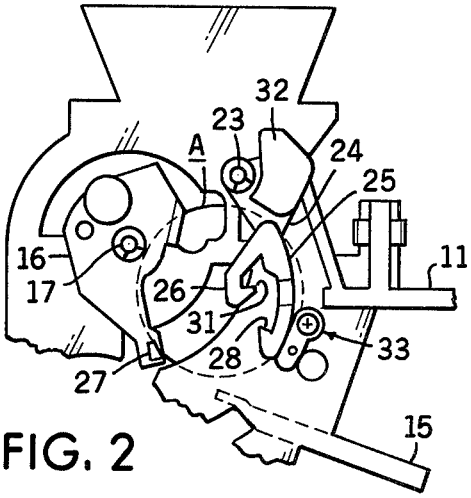
FIG. 2 is a view similar to FIG. 1, illustrating the cradle and latch lever in positions preparatory to releasing a coin toward an acceptance rail.
Figure 3:
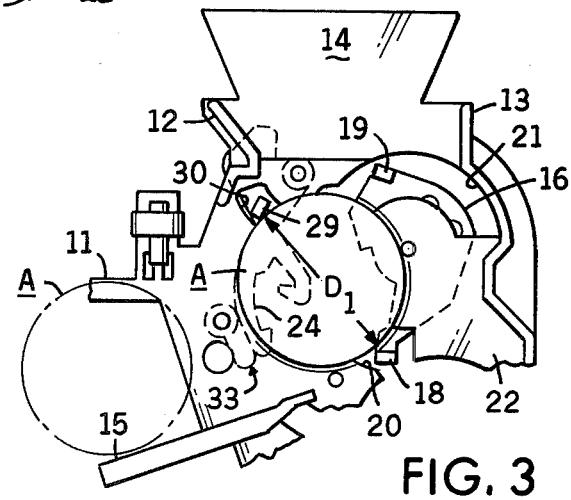
FIG. 3 is a fragmentary, elevational view of the inner side of the frame part, with cradle and latch lever in positions for releasing a coin of acceptable size toward the acceptance rail.

As the coin A moves through the entrance passageway 14 as shown in FIG. 1, it will be caught by the cradle arms 18–19 of cradle 16. The cradle 16 will then rotate about its pivot pin 17, and the coin edge will engage the lever shoulder 29 of the latch lever 24 as is best shown in FIGS. 2–3. As the lever 24 rotates, the distance between the lever shoulder 29 and the cradle arm 18 is increased until the latch lever 24 engages the stop arm 34. If the predetermined distance between the latch shoulder 29 and the cradle arm 18 is only slightly greater than the actual dimension D1 of the true value coin A, the true value coin A will pass between the latch shoulder 29 and the cradle arm 18, and pass into the acceptance passageway and onto the rail 15 as shown in broken lines in FIG. 3. If a spurious coin of only slightly greater diameter than the true value coin A is used in the assembly of FIGS. 1–3, such oversize coin cannot pass between the latch shoulder 29 and the cradle arm 18 and will thereby be jammed and held until released by suitable scavenging means.

By moving the stop arm 34 toward and away from the latch lever 24 as permitted by the screw fastener 35, the pivotal movement of the latch lever 24 can be limited exactly in a predetermined position so that the maximum distance between the latch shoulder 29 and the cooperating cradle arm 18 will pass only the true value coin of known diameter and will preclude passage of any oversize coin having only a slight difference in diameter.

Figure 4:
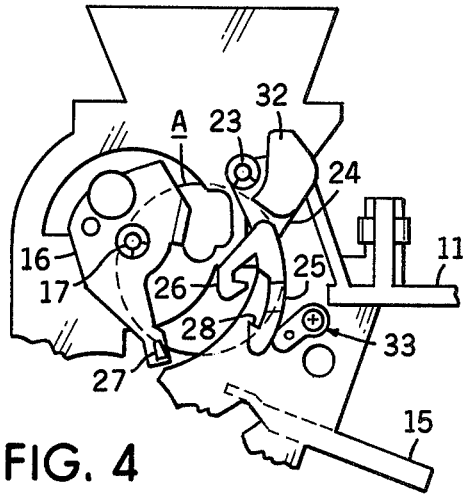
FIG. 4 is a view similar to FIG. 2, but illustrating an adjusted position of the stop means to limit the rotational position of the latch lever.
Figure 5:
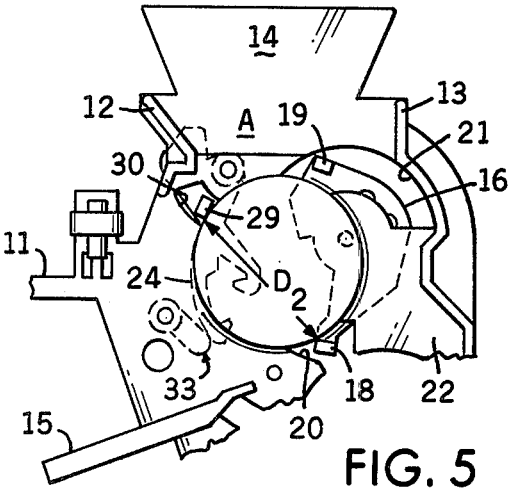
FIG. 5 is a view similar to FIG. 3, but illustrating the adjusted positions of the stop means and latch lever of FIG. 4 to preclude passage of an oversize coin to the acceptance rail.

To illustrate how the stop means 33 can be adjusted, and its effect in determining what size coin can pass between the lever shoulder 29 and the cradle arm 18, the stop means 33 is shown in a different adjusted position in FIGS. 4–5. In FIGS. 4–5, it will be understood that the latch arm 34 has been swung toward the latch lever 24 and fixed in position so as to reduce the extent of rotative movement of the latch lever 24 upon engagement. As a result, the maximum distance D2 between the lever shoulder 29 and the cradle arm 18 is less than the maximum distance D1 shown in FIG. 3. Consequently, the same coin A would not be allowed to pass between the lever shoulder 29 and the cradle arm 18, but rather would be precluded from passing into the acceptance passageway and would be held between the lever shoulder 29 and cradle arm 18 until removed by scavenging means.

I claim as my invention:

1. In a coin testing apparatus:

(a) a frame having means defining a coin passageway, (b) a coin cradle pivotally mounted on the frame, the cradle including a pair of spaced cradle arms for conveying a coin to the passageway, (c) a lever pivotally mounted on the frame adjacent the cradle, the lever having a shoulder disposed for contact with the edge of a coin carried in the cradle arms, the lever shoulder making contact wth the coin edge to pivot the lever and increase the distance between the lever shoulder and one cradle arm, (d) a stop means on the frame and engaging the lever to limit pivotal movement of the lever and determine the maximum distance between the lever shoulder and said one cradle arm for allowing a coin of acceptable size to pass between the lever shoulder and said one cradle arm to the passageway, and for precluding passage of an oversize coin between the lever shoulder and said one cradle arm, (e) the stop means being adjustably mounted to engage and limit movement of the lever at selective rotated positions of the lever for selectively varying the predetermined distance between the lever shoulder and said one cradle arm, and thereby selectively determining the size of the coin that will pass between the lever shoulder and said one cradle arm to the passageway, and (f) the stop means including:

(1) a stop arm, and (2) a fastener pivotally mounting the stop arm on the frame, the fastener allowing the stop arm to be pivotally moved selectively toward and away from the lever and to be selectively fixed to engage and limit movement of the lever at a selective rotated position of the lever.

* * * * *